US011767694B2

(12) United States Patent
Naganuma

(10) Patent No.: US 11,767,694 B2
(45) Date of Patent: Sep. 26, 2023

(54) HINGE

(71) Applicant: Sugatsune Kogyo Co., Ltd., Tokyo (JP)

(72) Inventor: Kenta Naganuma, Tokyo (JP)

( * ) Notice: Subject to any disclaimer, the term of this patent is extended or adjusted under 35 U.S.C. 154(b) by 0 days.

(21) Appl. No.: 16/766,607

(22) PCT Filed: Aug. 8, 2018

(86) PCT No.: PCT/JP2018/029719
§ 371 (c)(1),
(2) Date: May 22, 2020

(87) PCT Pub. No.: WO2019/102659
PCT Pub. Date: May 31, 2019

(65) Prior Publication Data

US 2020/0370348 A1 Nov. 26, 2020

(30) Foreign Application Priority Data

Nov. 24, 2017 (JP) ..... 2017-225562

(51) Int. Cl.
*E05F 3/20* (2006.01)
*E05D 7/04* (2006.01)
(Continued)

(52) U.S. Cl.
CPC ..... *E05D 3/02* (2013.01); *E05D 7/0018* (2013.01); *E05Y 2201/474* (2013.01); *E05Y 2201/638* (2013.01)

(58) Field of Classification Search
CPC ..... E05D 3/02; E05D 7/0018; E05D 11/10; E05D 11/1028; E05D 11/1042;
(Continued)

(56) References Cited

U.S. PATENT DOCUMENTS 6,305,050 B1 10/2001 Imai
7,162,774 B1 * 1/2007 Von Resch ..... E05D 7/0054 16/236
(Continued)

FOREIGN PATENT DOCUMENTS

CN 1540958 A 10/2004
CN 102116345 A 7/2011
(Continued)

OTHER PUBLICATIONS

English Translation of DE102007041640 Hodges (Year: 2009).*
(Continued)

*Primary Examiner* — Emily M Morgan
(74) *Attorney, Agent, or Firm* — Masuvalley & Partners; Peter Martinez

(57) ABSTRACT

In an assembled state of a hinge, the hinge is configured to be capable of adjusting a rotational position when holding a door or the like. The hinge includes a first member (1) and a second member (2) which are rotatable relative to each other. A first cam (11) is provided on the first member (1), a second cam (12) is provided on the second member (2) so as to be non-rotatable and movable in an axial direction thereof, and the second cam (12) is biased to the first cam (11) by biasing means (14) in the axial direction. The first cam (11) and the second cam (12) are configured to hold the second cam (12) in a predetermined rotational position relative to the first cam (11) by biasing force of the biasing means (14). In the assembled state of the hinge, it is possible to adjust the rotational position of the first cam (11) relative to the first member (1). The holding force of the first member (1) to the first cam (11) is larger than the holding force of the first cam (11) to the second cam (12) in a circumferential direction thereof.

3 Claims, 9 Drawing Sheets

(51) Int. Cl.
*E05D 3/02* (2006.01)
*E05D 7/00* (2006.01)

(58) Field of Classification Search
CPC ..... E05D 11/1078; E05D 2007/0461; E05D 7/0045; E05D 7/0054; E05D 2003/027; E05D 11/08; E05D 11/105; E05D 2011/1035; E05D 2011/1092; E05D 7/04; E05D 7/0415; E05D 7/0009; F16C 11/10; F16C 11/04; G06F 1/1681; E05Y 2201/474; E05Y 2201/638; E05F 3/20; E05F 1/065; E05F 1/1008
See application file for complete search history.

(56) References Cited

U.S. PATENT DOCUMENTS

| | | | | |
|---|---|---|---|---|
| 8,701,249 | B2 * | 4/2014 | Ahn | H04M 1/0216 16/330 |
| 2003/0101538 | A1 * | 6/2003 | Koshikawa | E05F 1/1223 16/277 |
| 2003/0208881 | A1 * | 11/2003 | Li | E05D 11/1007 16/330 |
| 2004/0025299 | A1 * | 2/2004 | Higano | G06F 1/1679 16/342 |
| 2006/0064850 | A1 * | 3/2006 | Sato | H04M 1/0212 16/330 |
| 2007/0089273 | A1 * | 4/2007 | Kang | E05D 11/1078 16/330 |
| 2011/0157787 | A1 | 6/2011 | Duan et al. | |
| 2011/0286160 | A1 | 11/2011 | Duan et al. | |
| 2014/0259532 | A1 * | 9/2014 | Millard | E05D 11/1028 16/326 |
| 2015/0345203 | A1 * | 12/2015 | Vanini | E05F 5/027 16/53 |
| 2018/0223574 | A1 * | 8/2018 | Babikian | E05D 3/02 |

FOREIGN PATENT DOCUMENTS

| | | | | | |
|---|---|---|---|---|---|
| CN | 102252014 | A | | 11/2011 | |
| CN | 102761634 | B | | 12/2016 | |
| CN | 108798326 | A | * | 11/2018 | |
| DE | 202006013550 | U1 | * | 12/2006 | A47K 3/36 |
| DE | 102007041640 | A1 | * | 3/2009 | E05F 1/063 |
| EP | 0704594 | A1 | * | 9/1995 | E05D 7/10 |
| EP | 1598510 | A2 | * | 11/2005 | E05D 7/0045 |
| JP | H10-306645 | A | | 11/1998 | |
| JP | 2000-337008 | A | | 12/2000 | |
| JP | 2004-108110 | A | | 4/2004 | |
| JP | 2006-037392 | A | | 2/2006 | |
| JP | 2007-085469 | A | | 4/2007 | |
| KR | 870004016 | Y1 | * | 12/1987 | |
| KR | 100476742 | B1 | * | 3/2005 | E05F 1/063 |
| KR | 101123852 | B1 | * | 3/2012 | |
| KR | 20150040499 | A | * | 4/2015 | |
| KR | 101705221 | B1 | * | 2/2017 | |
| KR | 20180025629 | A | * | 3/2018 | |
| KR | 20200065527 | A | * | 9/2020 | |
| WO | WO-2008100035 | A1 | * | 8/2008 | E05F 1/1215 |
| WO | WO-2011069001 | A | * | 6/2011 | E05D 11/06 |
| WO | WO-2019102659 | A1 | * | 5/2019 | E05D 3/02 |

OTHER PUBLICATIONS

Taiwanese Office Action dated Aug. 13, 2019, issued in Taiwanese Application No. 107137793, total 6 pages.
WIPO, Japan International Search Authority, International Search Report and Written Opinion dated Oct. 2, 2018 in International Patent Application No. PCT/JP2018/029719, 10 pages.

* cited by examiner (a)

(b)

(a)

(b)

HINGE

RELATED APPLICATIONS

This application is the U.S. National Phase of and claims priority to International Patent Application No. PCT/JP2018/029719, International Filing Date Aug. 8, 2018, entitled Hinge; which claims benefit of Japanese Application No. JP2017-225562 filed Nov. 24, 2017; both of which are incorporated herein by reference in their entireties.

TECHNICAL FIELD

The present invention relates to a hinge including a first member and a second member which are rotatable relative to each other.

BACKGROUND

A hinge is used to enable a door, a lid, a display, or the like (hereinafter, referred to as "the door or the like") to open and be closed relative to a main body of, for example, furniture, apparatus, electronic equipment, or the like. The hinge includes a first member and a second member which are rotatable relative to each other. The first member is provided on the main body, and the second member is provided on the door or the like.

As one type of hinge, there is known a hinge which enables the second member to be held in a predetermined rotational position (see, Patent Document 1). This type of hinge includes a first cam fixed to the first member, a second cam provided on the second member so as to be non-rotatable and movable in an axial direction thereof, and biasing means for biasing the second cam to the first cam in the axial direction. The first cam and the second cam are formed in such a way that the second cam can be held in a predetermined rotational position relative to the first cam by biasing force of the biasing means. Since the second member is not rotatable relative to the second cam, and the first member is fixed to the first cam, it is possible to hold the second member at the predetermined rotational position relative to the first member.

This type of hinge enables the door or the like to be held in, for example, a closed position and/or an open position. This makes it possible to keep a closed state and/or an open state of the door or the like. Further, since the door or the like can be held in, for example, an intermediate position between the closed position and the open position, it becomes easier for a user to get an accommodating object in or out the main body.

PRIOR ART DOCUMENT

Patent Document

The Patent Document 1 is JP-H10-306645 A

SUMMARY OF THE INVENTION

Problem to be Solved by the Invention

However, the conventional hinge has a problem that it is impossible to adjust the rotational position when holding the door or the like in an assembled state of the hinge. It is desired to adjust the rotational position when holding the door or the like so as to meet a usage situation of furniture, apparatus, or the like.

It is therefore an object of the present invention to provide the hinge capable of adjusting the rotational position when holding the door or the like in the assembled state of the hinge.

Means for Solving the Problem

In order to solve the above problem, one aspect of the present invention is a hinge including a first member and a second member which are rotatable relative to each other, the hinge including: a first cam provided on the first member; a second cam provided on the second member so as to be non-rotatable and movable in an axial direction thereof; and biasing means for biasing the second cam to the first cam in the axial direction, in which the first cam and the second cam are configured to hold the second cam in a predetermined rotational position relative to the first cam by biasing force of the biasing means, in which a rotational position of the first cam relative to the first member is adjustable in an assembled state of the hinge, and in which the holding force of the first member to the first cam is larger than the holding force of the first cam to the second cam in a circumferential direction thereof.

Effect of the Invention

According to the present invention, the position of the first cam relative to the first member is adjustable in the assembled state of the hinge, and the first cam and the second cam are configured to hold the second cam in the predetermined rotational position relative to the first cam by the biasing force of the biasing means. This makes it possible to adjust the rotational position when holding the second member relative to the first member. Therefore, it is possible to adjust the rotational position when holding the door or the like. Further, the holding force of the first member to the first cam is larger than the holding force of the first cam to the second cam in the circumferential direction thereof. For this reason, when rotating the second cam, it is possible to prevent rotation of the first cam of which position is adjusted relative to the first member.

MODE FOR CARRYING OUT THE INVENTION

Hereinafter, based on the accompanying drawings, the hinge of each of the embodiments according to the present invention will be described in detail. However, the hinge of the present invention can be embodied in various forms and is not limited to the embodiments described herein. These embodiments are provided with an intention that the disclosure of the specification is made sufficient to enable a person skilled in the art to fully understand the scope of the invention.

First Embodiment

Figure 1:
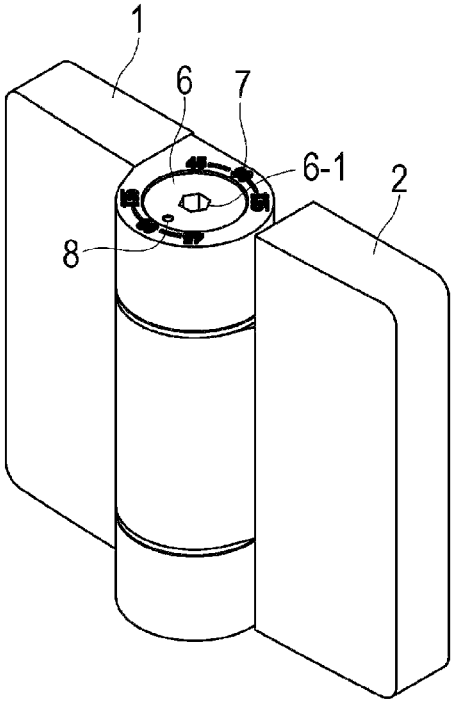
FIG. 1 is a perspective view of the hinge of the first embodiment according to the present invention (FIG. 1(*a*) shows a closed position of the second member and FIG. 1(*b*) shows an open position of the second member).
Figure 1:
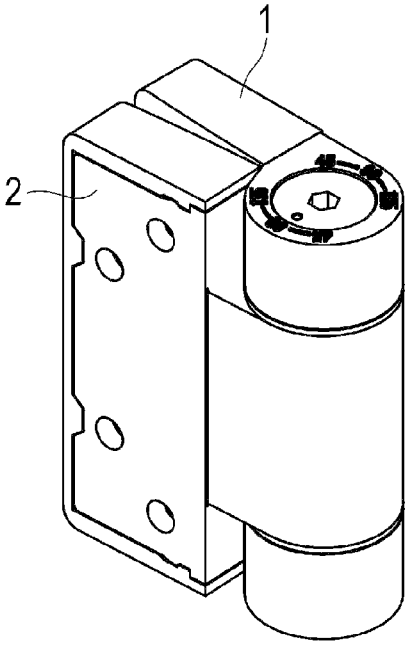

Each of FIGS. 1(*a*) and 1(*b*) shows a perspective view of the hinge of the first embodiment according to the present invention. The hinge includes a first member 1 and a second member 2 which are rotatably connected to each other. FIG. 1(*a*) shows a closed position of the second member 2, and FIG. 1(*b*) shows an open position of the second member 2. The second member 2 rotates from the closed position to the open position relative to the first member 1.

In the closed position, the rotational position of the second member 2 relative to the first member 1 is, for example, −4°. This rotational position is an angle α formed between an attaching surface 2-1 of the second member 2 and a virtual plane P extending from an attaching surface 1-1 of the first member 1 towards the second member 2 (see FIG. 8(*a*)). On the other hand, in the open position, the rotational position of the second member 2 relative to the first member 1 is, for example, 177° (see an angle β in FIG. 9(*a*)). The second member 2 is held in the closed position and the open position relative to the first member 1.

Figure 2:
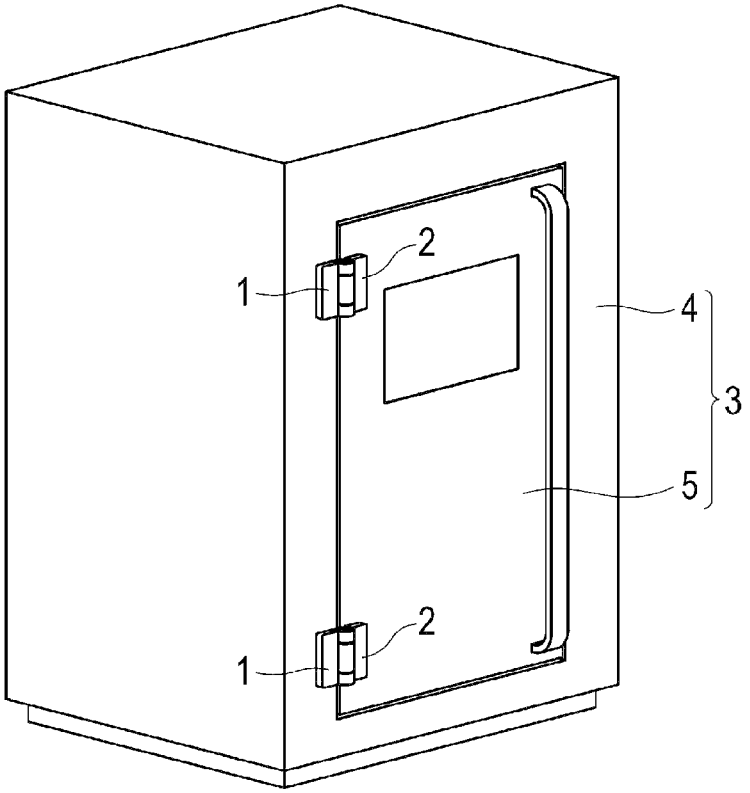
FIG. 2 is a perspective view showing an example in which the hinge of the present embodiment is attached to a device (FIG. 2(*a*) shows a closed position of the door and FIG. 2(*b*) shows an intermediate position of the door).
Figure 2:
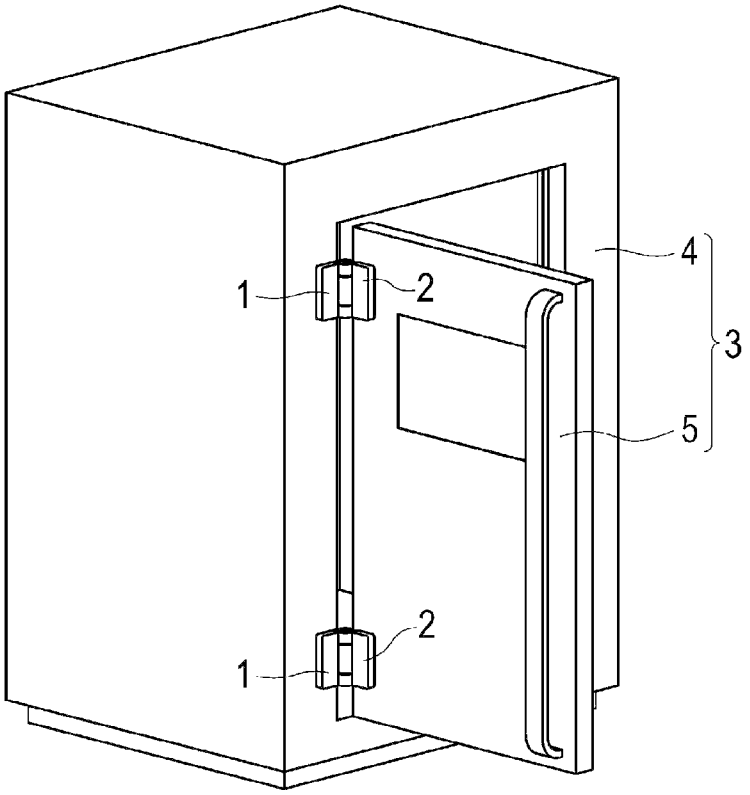

Each of FIGS. 2(*a*) and 2(*b*) shows an example in which the hinge is attached to a device 3. The device 3 includes a main body 4 and a door 5. The first member 1 is attached to the main body 4, and the second member 2 is attached to the door 5.

FIG. 2(*a*) shows a closed position of the door 5. In the closed position of the door 5, the rotational position of the door 5 relative to the main body 4 is 0°. And, the rotational position of the second member 2 relative to the first member 1 is also 0°. As shown in FIG. 1(*a*), in the closed position of the hinge itself, the rotational position of the second member 2 relative to the first member 1 is −4°. This is because in the closed position of the door 5 shown in FIG. 2(*a*), the door 5 is applied with biasing force in a closed direction thereof.

As shown in FIG. 2(*b*), the door 5 is held even at an intermediate position between the closed position and the open position. In this embodiment, the intermediate position is adjustable to a plurality of rotational positions, e.g., any one of 45°, 90° and 135°.

As shown in FIG. 1, the hinge is provided with a shaft body 6 for adjusting the intermediate position when holding the door 5. The shaft body 6 has a hole 6-1 such as a hexagonal hole to which a tool such as a hexagonal wrench is to be inserted. The intermediate position is adjusted by rotating the shaft body 6 relative to the first member 1 using such a tool. In order to see the adjusted intermediate position, the first member 1 is provided with a scale 7 of 45°, 90° and 135°, and the shaft body 6 is provided with a mark 8.

Figure 3:
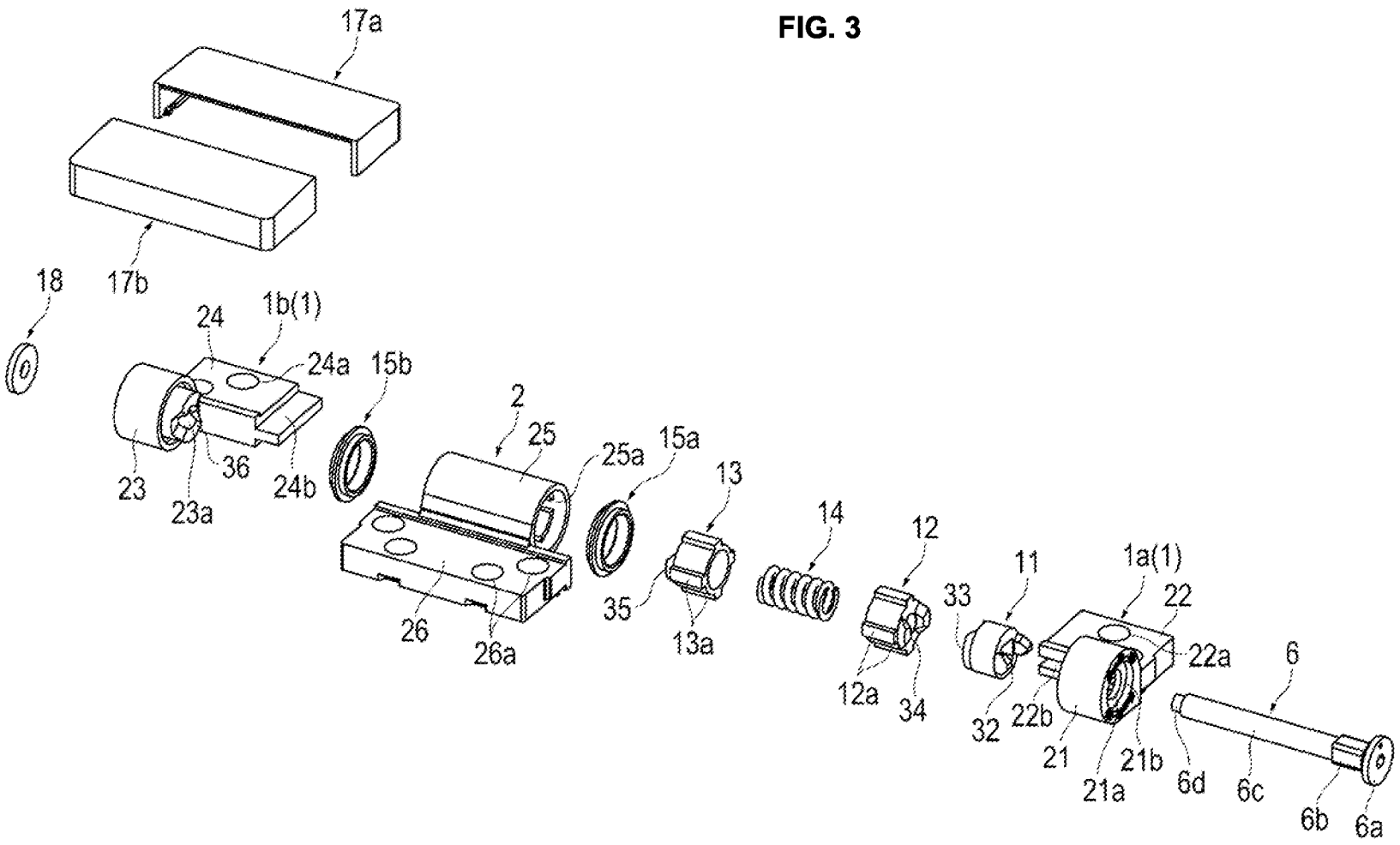
FIG. 3 is an exploded perspective view of the hinge of the present embodiment.

FIG. 3 shows an exploded perspective view of the hinge. The reference 1 denotes the first member, the reference 2 denotes the second member, the reference 11 denotes the first cam, the reference 12 denotes the second cam, the reference 13 denotes the third cam, the reference 14 denotes a spring as the biasing means, and the reference 6 denotes the shaft body. These components will be described below in order.

The first member 1 is configured by connecting two divided bodies 1*a* and 1*b*. The divided body 1*a* includes a plate-shaped attaching portion 22 and a cylindrical-shaped body portion 21 having a bottom portion. A cylindrical-shaped first cam 11 is rotatably accommodated in the body portion 21. A hole 21*a* through which the shaft body 6 rotatably penetrates is formed in the bottom portion of the body portion 21. A cam portion 31 cooperating with the first cam 11 (FIG. 5(*b*) and FIG. 5(*c*)) is formed in a surface of the bottom portion of the body portion 21 facing to the first cam 11. Further, a seat 21*b* in which a head portion 6*a* of the shaft body 6 is rotatably seated is formed at a side of the bottom portion of the body portion 21 opposite to the first cam 11. An attaching hole 22*a* for attaching the first member 1 to the main body 4 of the device 3 by a fastening member such as a screw is formed in the attaching portion 22. A recess 22*b* is formed in the attaching portion 22.

The divided body 1*b* includes a plate-shaped attaching portion 24 and a cylindrical-shaped body portion 23. A hole 23*a* through which the shaft body 6 rotatably penetrates is formed in the body portion 23. A cam portion 36 cooperating with the third cam 13 (see also FIG. 5(*c*)) is formed in a surface of the body portion 23 facing to the third cam 13. An attaching hole 24*a* for attaching the first member 1 to the main body 4 of the device 3 by a fastening member such as a screw is formed in the attaching portion 24. A protrusion 24*b* which fits into the recess 22*b* is formed in the attaching portion 24. The protrusion 24*b* is fitted into the recess 22*b*, thereby making the two divided bodies 1*a* and 1*b* non-rotatable relative to each other. The divided bodies 1*a* and 1*b* are connected by the shaft body 6 in a state where a body portion 25 of the second member 2 is sandwiched between the body portions 21 and 23.

The second member 2 includes a plate-shaped attaching portion 26 and the cylindrical-shaped body portion 25. In an inner surface of the body portion 25, guide grooves 25*a* extending in the axial direction thereof are formed. The guide grooves 25*a* are provided at predetermined intervals in the circumferential direction thereof. At one side of the axial direction of the body portion 25, the second cam 12 is accommodated so as to be non-rotatable and movable in the axial direction. Further, at the other side of the axial direction of the body portion 25, the third cam 13 is accommodated so as to be non-rotatable and movable in the axial direction. Attaching holes 26*a* for attaching the second member 2 to the door 5 of the device 3 by fastening members such as screws are formed in the attaching portion 26. The attaching portions 22 and 24 of the first member 1 and the attaching portion 26 of the second member 2 are covered with decorative covers 17*a* and 17*b* respectively.

Figure 4:
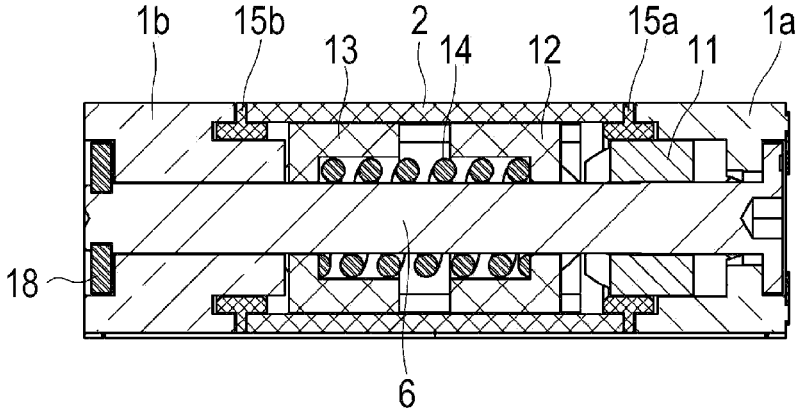
FIG. 4 is a cross-sectional view taken along an axis of rotation of the hinge of the present embodiment.

Between the body portion 25 of the second member 2 and the body portions 21 and 23 of the first member 1, ring-shaped collars 15*a* and 15*b* for stabilizing the rotation of them relative to each other are interposed respectively. Each of the collars 15*a* and 15*b* includes a cylindrical portion and a flange portion provided in the center of an axial direction of the cylindrical portion. As shown in FIG. 4, the flange portion of each of the collars 15*a* and 15*b* is sandwiched between the first member 1 and the second member 2. The cylindrical portion of each of the collar 15*a* and 15*b* fits inside the body portions 21 and 25 of the first member 1 and the second member 2.

As shown in FIG. 3, the first cam 11 is of a cylindrical shape. The first cam 11 is rotatably accommodated in the body portion 21 of the first member 1. The shaft body 6 is inserted into the first cam 11. The first cam 11 is non-rotatable to the shaft body 6 and movable in an axial direction of the shaft body 6. A cross-section of the inner surface of the first cam 11 is a variant shape such as a rectangular shape, an oval shape, or the like. A first cam portion 32 (see also FIG. 5(*c*)) is formed at one end portion of the first cam 11. A second cam portion 33 (see also FIG. 5(*c*)) is formed at the other end portion of the first cam 11.

The second cam 12 is of a substantially cylindrical shape. The second cam 12 is non-rotatable relative to the body portion 25 of the second member 2 and movable in the axial direction thereof. In the outer surface of the second cam 12, guide projections 12*a* extending in the axial direction are formed. The guide projections 12*a* are provided at intervals in the circumferential direction thereof. The guide projections 12*a* fit into the guide grooves 25*a* of the body portion 25 of the second member 2, respectively. At one end portion of the second cam 12, a cam portion 34 (see also FIG. 5(*c*)) is formed.

The third cam 13 is of a substantially cylindrical shape. The third cam 13 is non-rotatable relative to the body portion 25 of the second member 2 and movable in the axial direction thereof. In the outer surface of the third cam 13, guide projections 13*a* extending in the axial direction are formed. The guide projections 13*a* are provided at intervals in the circumferential direction thereof. The guide projections 13*a* fit into the guide grooves 25*a* of the body portion 25 of the second member 2, respectively. A cam portion 35 (see also FIG. 5(*c*)) is formed at one end portion of the third cam 13.

As shown in FIG. 4, between the second cam 12 and the third cam 13, a spring 14 such as a coil spring or the like is interposed. The spring 14 biases the second cam 12 to the first cam 11. Further, the spring 14 biases the first cam 11 to the first member 1 via the second cam 12. Furthermore, the spring 14 biases the third cam 13 to the first member 1 in a direction opposite to the second cam 12.

The shaft body 6 penetrates through the body portion 21 of the first member 1, the first cam 11, the second cam 12, the spring 14, the third cam 13, the collar 15*a*, the collar 15*b*, the second member 2 and the body portion 23 of the first member 1. After the shaft body 6 is penetrated through these parts, a caulking portion 6*d* of the distal end of the shaft body 6 is caulked and fixed to a washer 18, thereby the hinge being assembled.

As shown in FIG. 3, the shaft body 6 includes, in order from the proximal end side to the distal end side, a head portion 6*a* which protrudes in a flange shape, a rotation-limiting portion 6*b* of which cross-section has a variant shape, a column-shaped elongated portion 6*c* and the caulking portion 6*d*. The rotation-limiting portion 6*b* of the shaft body 6 fits on the inner surface of the first cam 11. The cross-section of the rotation-limiting portion 6*b* is shaped so as to match the inner surface of the first cam 11.

Figure 5:
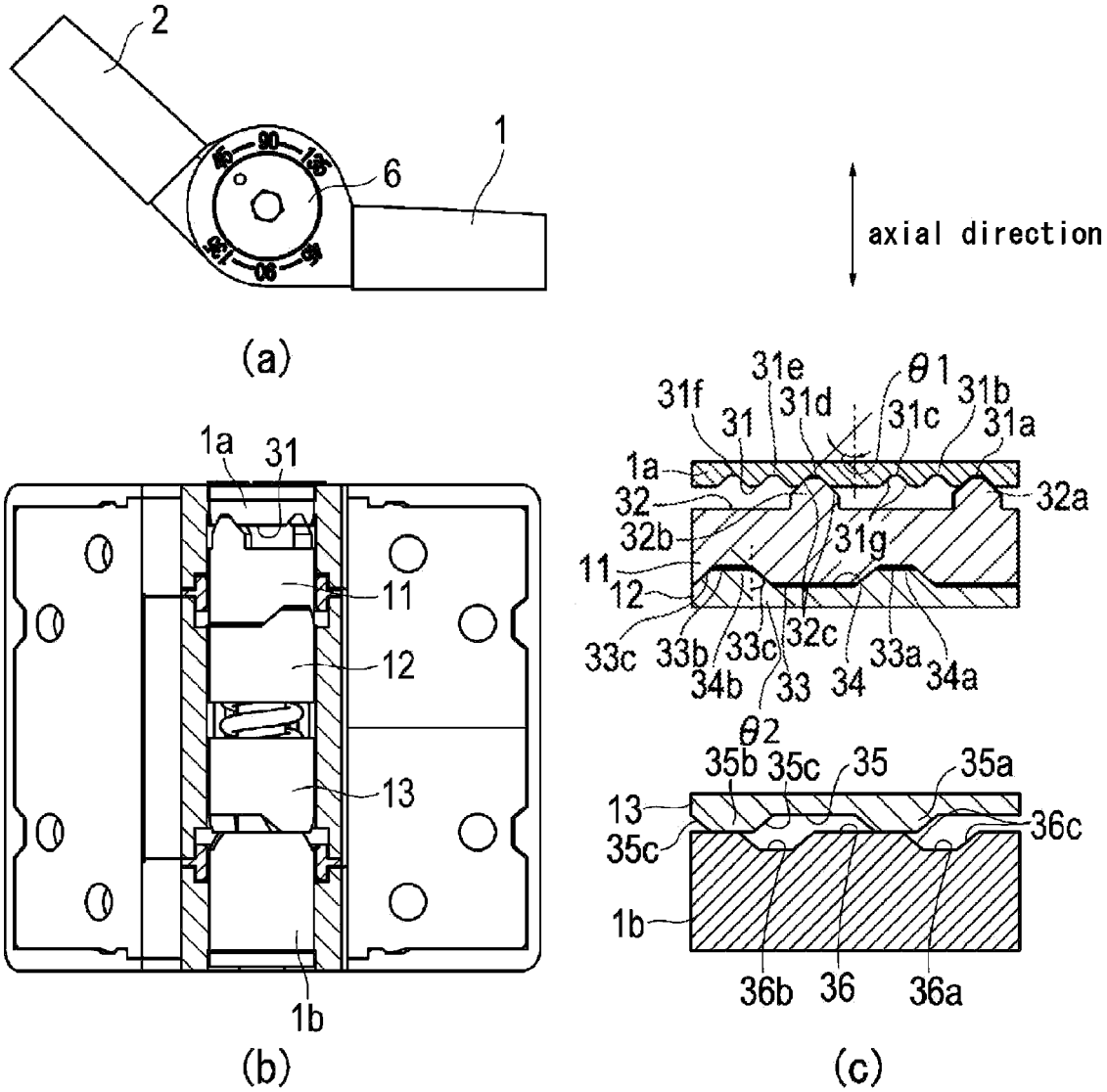
FIG. 5 is a diagram showing an example in which the first cam is adjusted to a rotational position of 45° relative to the first member (FIG. 5(*a*) is a side view of the hinge, FIG. 5(*b*) is a bottom view of the hinge partially shown in a cross-sectional view, and FIG. 5(*c*) is a developed view of the cams).
Figure 6:
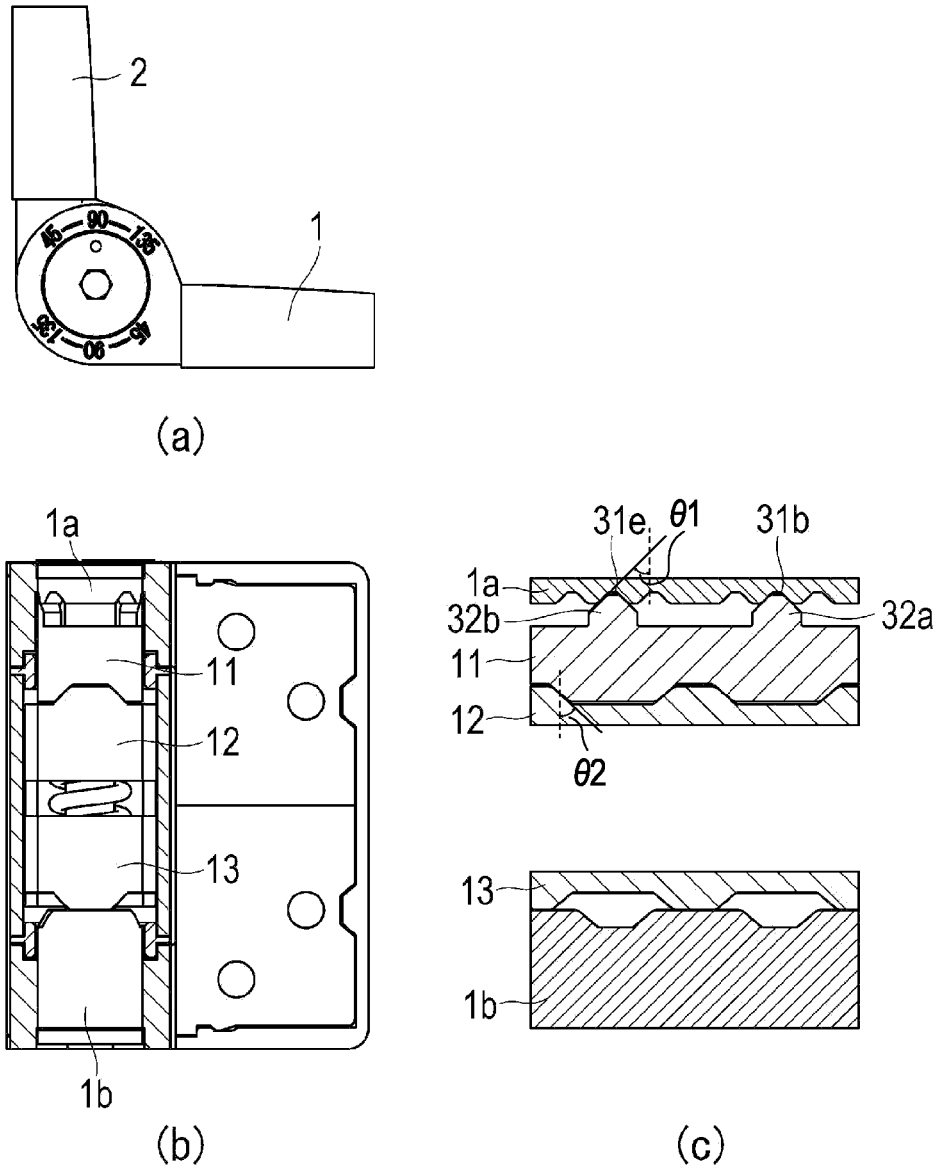
FIG. 6 is a diagram showing an example in which the first cam is adjusted to a rotational position of 90° relative to the first member.
Figure 7:
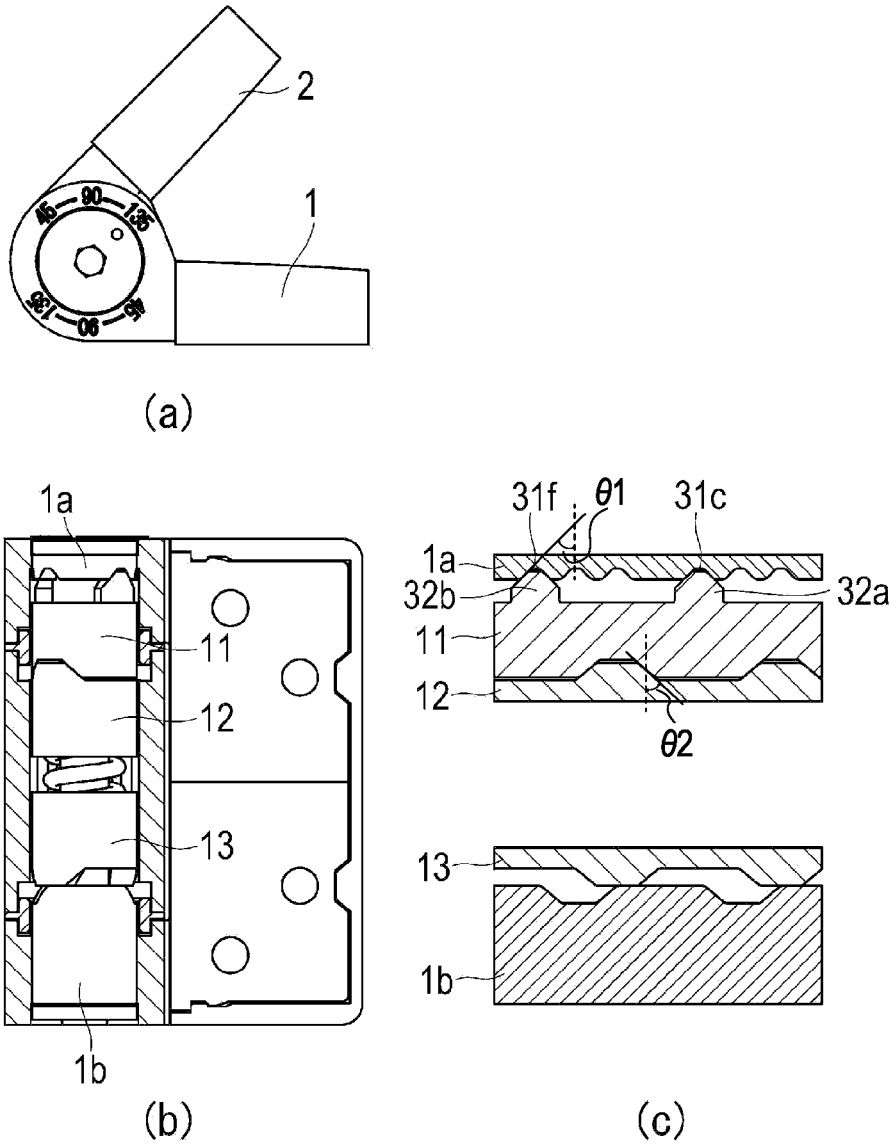
FIG. 7 is a diagram showing an example in which the first cam is adjusted to a rotational position of 135° relative to the first member.

FIG. 5 shows an example in which the first cam 11 is adjusted to a rotational position of 45° relative to the first member 1 in an assembled state of the hinge. FIG. 5(*a*) is a side view of the hinge. FIG. 5(*b*) is a bottom view of the hinge partially shown in a cross-sectional view. FIG. 5(*c*) shows a developed view of the divided body 1*a*, the first cam 11, the second cam 12, the third cam 13 and the divided body 1*b*.

In the developed view of FIG. 5(*c*), the reference 31 denotes the cam portion of the divided body 1*a*, the reference 32 denotes the first cam portion of the first cam 11, the reference 33 denotes the second cam portion of the first cam 11, the reference 34 denotes the cam portion of the second cam 12, the reference 35 denotes the cam portion of the third cam 13, and the reference 36 denotes the cam portion of the divided body 1*b*.

As shown in FIG. 5(*c*), a recess 31*a* is formed in the cam portion 31 of the divided body 1*a* at the position of 45°, a recess 31*b* is formed therein at the position of 90°, and a recess 31*c* is formed therein at the position of 135°. Further, a recess 31*d* is formed in the cam portion 31 at the position of 45°+180°, a recess 31*e* is formed therein at the position of 90°+180°, and a recess 31*f* is formed therein at the position of 135°+180°. The recess 31*a* and the recess 31*d* are paired, the recess 31*b* and the recess 31*e* are paired, and the recess 31*c* and the recess 31*f* are paired.

The shapes of the six recesses 31*a* to 31*f* are identical to each other, and each of them is trapezoidal. Each of the recesses 31*a* to 31*f* is symmetrical relative to the axial direction, and has a pair of inclined surfaces 31*g*. An angle formed between each inclined surface 31*g* and the axial direction is θ1.

A pair of protrusions 32*a* and 32*b* are formed in the first cam portion 32 of the first cam 11 at intervals of 180° in the circumferential direction thereof. The shapes of the protrusions 32*a* and 32*b* are identical to each other, and both of them are trapezoidal. Each of the protrusions 32*a* and 32*b* is symmetrical relative to the axial direction, and has a pair of inclined surfaces 32*c*. An angle formed between each inclined surface 32*c* and the axial direction is also θ1.

When rotating the first cam 11 relative to the divided body 1*a*, the pair of protrusions 32*a* and 32*b* of the first cam 11 are fitted to any one of the three sets of the pairs of recesses 31*a* to 31*f* When adjusting the rotational position of the first cam 11 relative to the divided body 1*a*, the shaft body 6 is rotated using a tool. The first cam 11 is non-rotatably fitted to the shaft body 6 so as to be movable in the axial direction thereof. For this reason, when rotating the shaft body 6, the first cam 11 is moved in the axial direction against the biasing force of the spring 14 in such a way that the protrusions 32*a* and 32*b* of the first cam 11 ride over the inclined surfaces of the recesses 31*a* and 31*d* of the first member 1. As a result, the protrusions 32*a* and 32*b* are fitted to the adjacent recesses 31*b* and 31*e*. Thus, the rotational position of the first cam 11 relative to the first member 1 can be adjusted to any one of 45°, 90° and 135°. After adjusting the rotational position of the first cam 11, the first cam 11 is held in the adjusted rotational position by the biasing force of the spring 14.

A pair of recesses 33*a* and 33*b* are formed in the second cam portion 33 of the first cam 11 at intervals of 180° in the circumferential direction thereof (see FIG. 5 (*c*)). The shapes of the recesses 33*a* and 33*b* are identical to each other, and both of them are trapezoidal. Each of the recesses 33*a* and 33*b* is symmetrical relative to the axial direction, and has a pair of inclined surfaces 33*c* (see FIG. 5(*c*)). An angle formed between each inclined surface 33*c* and the axial direction is θ2. θ2 is larger than θ1.

Figure 9:
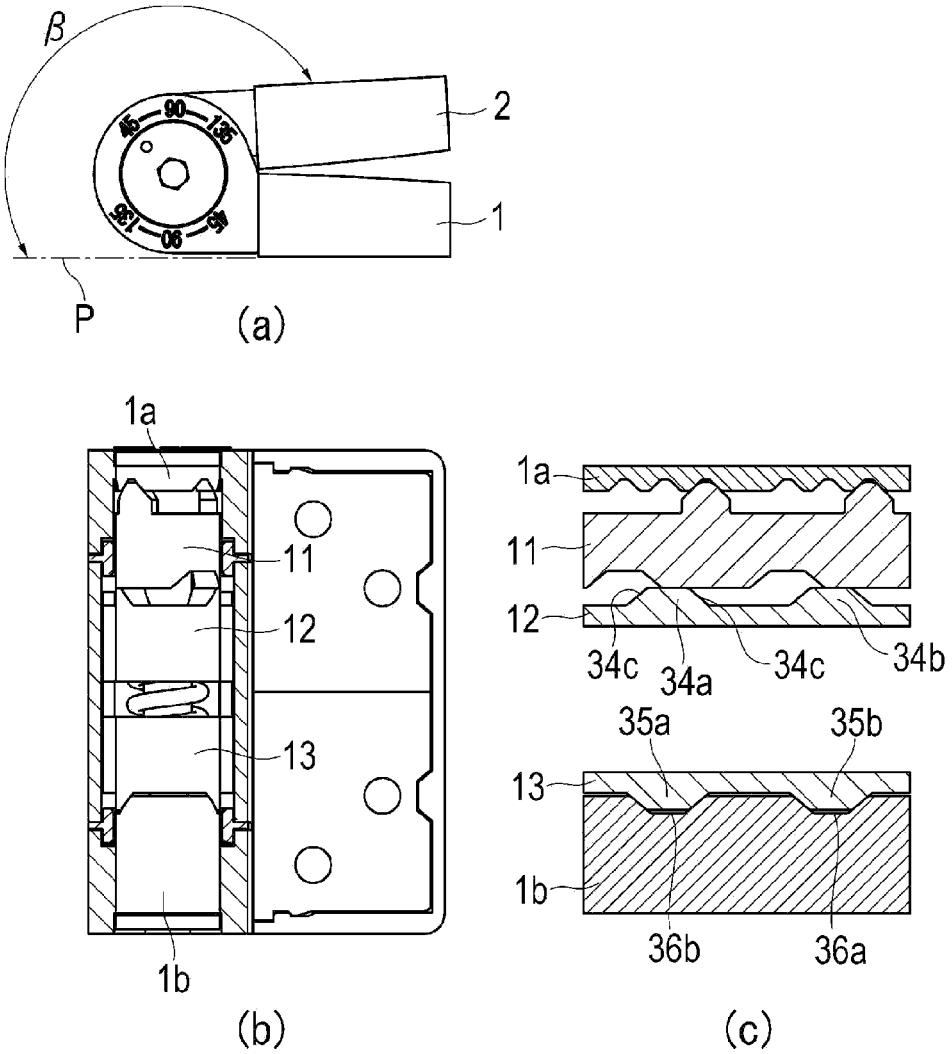
FIG. 9 is a diagram showing an example in which the second member is held in an open position.

A pair of protrusions 34*a* and 34*b* are formed in the cam portion 34 of the second cam 12 at intervals of 180° in the circumferential direction thereof (see also FIG. 9(*c*)). The shapes of the protrusions 34*a* and 34*b* are identical to each other, and both of them are trapezoidal. Each of the protrusions 34*a* and 34*b* is symmetrical relative to the axial direction, and has a pair of inclined surfaces 34*c* (see FIG. 9(*c*)). An angle formed between each inclined surface 34*c* and the axial direction is also θ2.

When rotating the second cam 12 relative to the first cam 11, the protrusions 34*a* and 34*b* of the second cam 12 are fitted to the recesses 33*a* and 33*b* of the first cam 11. In this way, the protrusions 34*a* and 34*b* of the second cam 12 are fitted to the recesses 33*a* and 33*b* of the first cam 11, and then the second cam 12 is held in a predetermined rotational position relative to the first cam 11 by the biasing force of the spring 14.

As described above, the rotational position of the first cam 11 can be adjusted to any one of 45°, 90° and 135° relative to the divided body 1*a*. For this reason, the rotational position when holding the second cam 12 and thus the second member 2 can be also adjusted to any of 45°, 90° and 135°.

An inclination angle θ1 of the inclined surface 32*c* of the first cam portion 32 of the first cam 11 is smaller than the inclination angle θ2 of the inclined surface 34*c* of the cam portion 34 of the second cam 12. The holding force of the divided member 1*a* to the first cam 11 is larger than the holding force of the first cam 11 to the second cam 12 in the circumferential direction thereof. Therefore, when rotating the second member 2, only the second cam 12 is rotated without rotating the adjusted first cam 11.

A pair of protrusions 35*a* and 35*b* are formed in the cam portion 35 of the third cam 13 at intervals of 180° in the circumferential direction thereof. The shapes of the protrusions 35*a* and 35*b* are identical to each other, and both of them are trapezoidal. Each of the protrusions 35*a* and 35*b* is symmetrical relative to the axial direction, and has a pair of inclined surfaces 35*c*. An angle formed between each inclined surface 35*c* and the axial direction is θ2 (see FIG. 8(*c*)).

A pair of recesses 36*a* and 36*b* are formed in the cam portion 36 of the divided body 1*b* at intervals of 180° in the circumferential direction thereof. The shapes of the recesses 36*a* and 36*b* are identical to each other, and both of them are trapezoidal. Each of the recesses 36*a* and 36*b* is symmetrical relative to the axial direction, has a pair of inclined surfaces 36*c*. An angle formed between each inclined surface 36*c* and the axial direction is also θ2 (see FIG. 8(*c*)).

Figure 8:
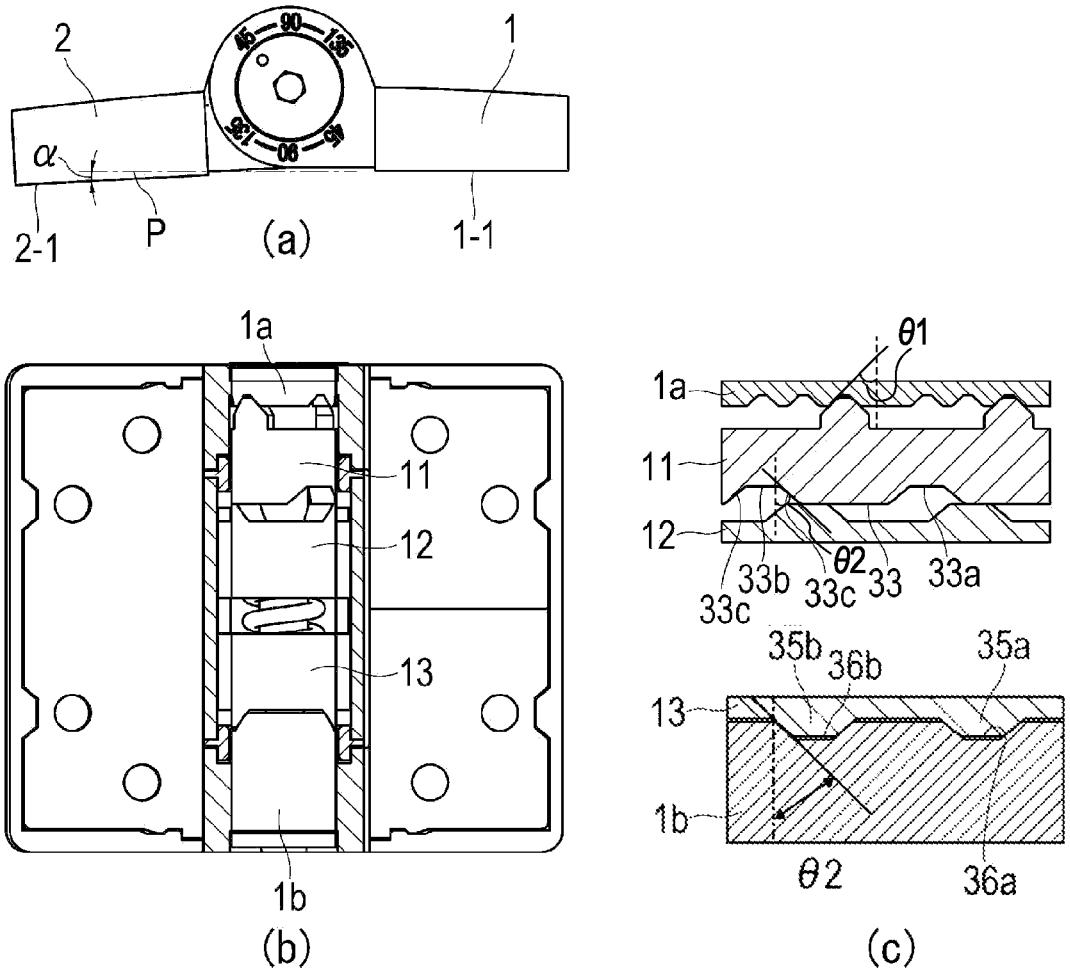
FIG. 8 is a diagram showing an example in which the second member is held in a closed position.

FIG. 8 shows an example in which the second member 2 is held in a closed position, and FIG. 9 shows an example in which the second member 2 is held in an open position. The third cam 13 and the divided body 1*b* are formed in such a way that the protrusions 35*a* and 35*b* of the third cam 13 fit to the recesses 36*a* and 36*b* of the first member 1 by the biasing force of the spring 14 when the second member 2 is in the closed position and the open position. As a result, the second member 2 is held in the open position and the closed position.

The configuration of the hinge of the first embodiment has been described above. The hinge of the first embodiment has the following effects.

According to the hinge of the present embodiment, in an assembled state of the hinge, the rotational position of the first cam 11 can be adjusted to any of a plurality of rotational positions. Since the second cam 12 is held in a predetermined rotational position relative to the first cam 11 by the biasing force of the spring 14, the rotational position when holding the second member 2 can be adjusted to any of the plurality of rotational positions. Therefore, it is possible to adjust the intermediate position when holding the door 5. Further, the holding force of the first member 1 to the first cam 11 is larger than the holding force of the first cam 11 to the second cam 12 in the circumferential direction thereof. For this reason, when rotating the second cam 12, it is possible to prevent the rotation of the first cam 11 of which position is adjusted relative to the first member 1.

Since the spring 14 works for both biasing the second cam 12 to the first cam 11 and biasing the first cam 11 to the first member 1, it is possible to reduce the number of parts of the hinge and simplify the mechanism of the hinge.

By rotating the shaft body 6, the rotational position of the first cam 11 relative to the first member 1 is adjusted. For this reason, it is easy to adjust the rotational position of the first cam 11.

Since the second member 2 is provided with the third cam 13, it is possible to hold the second member 2 being positioned in the closed position and the open position.

Second Embodiment

Figure 10:
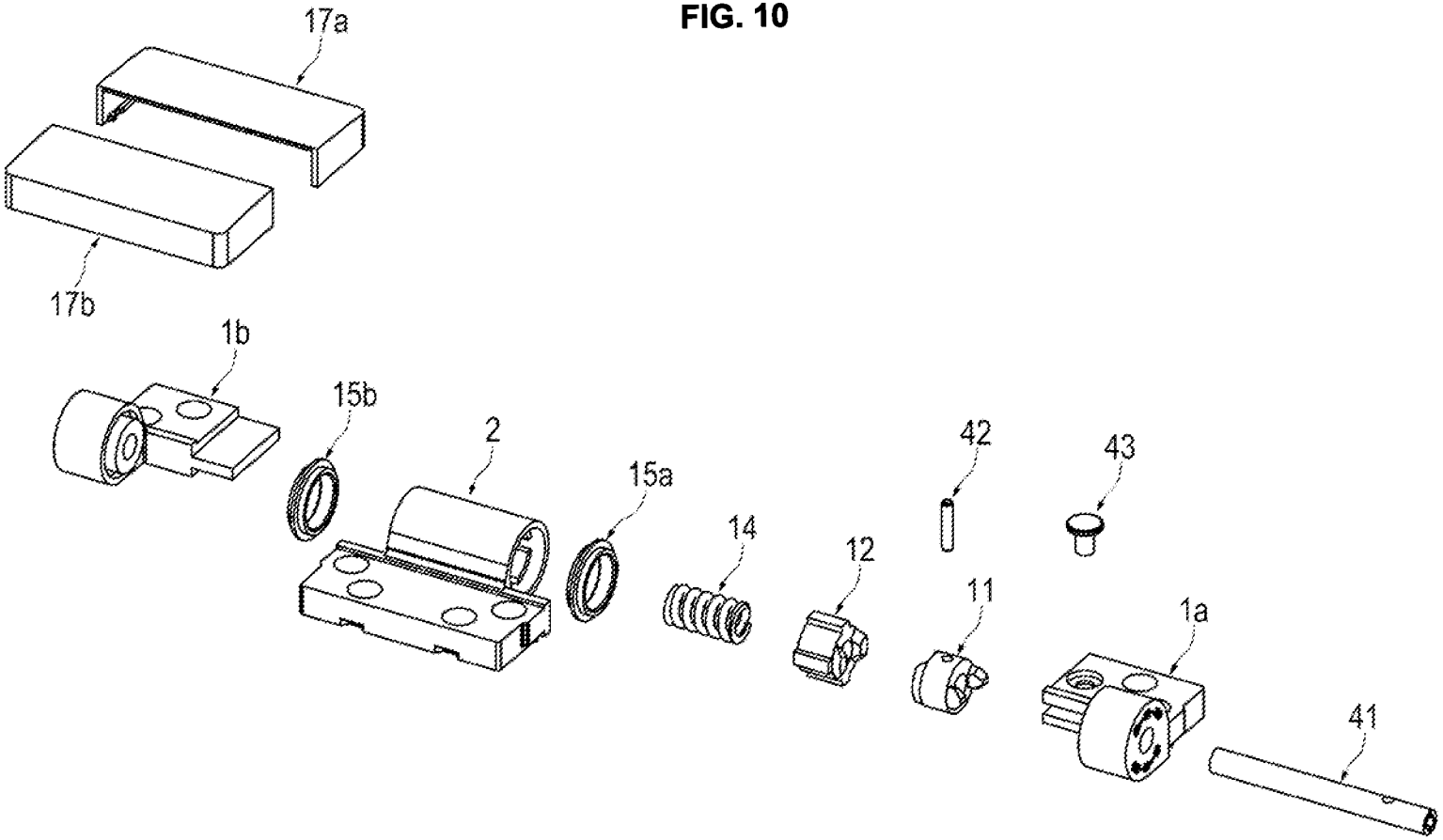
FIG. 10 is an exploded perspective view of the hinge of the second embodiment according to the present invention.

FIG. 10 shows an exploded perspective view of the hinge of the second embodiment according to the present invention. The second embodiment is different from the first embodiment in that the first cam 11 is provided on a shaft body 41 so as to be non-movable in an axial direction thereof, and the third cam 13 is not provided. Since the configurations of the two divided bodies 1*a* and 1*b* of the first member 1, the second member 2, the first cam 11, the second cam 12, the spring 14, the collar 15*a*, the collar 15*b*, the decorative cover 17*a* and the decorative cover 17*b* are substantially the same as those of the first embodiment, the descriptions thereof will be omitted with reference to the same references.

The shaft body 41 is of a column shape. The first cam 11 and the shaft body 41 are connected by a pin 42 so as to be non-rotatable and non-movable in the axial direction thereof. When adjusting the rotational position of the first cam 11, the shaft body 41 is rotated while pressing the shaft body 41 against the biasing force of the spring 14. After adjusting the rotational position of the first cam 11, the rotational position of the first cam 11 is held by the biasing force of the spring 14. The divided bodies 1*a* and 1*b* are fastened to each other by a fastening member 43 such as a screw.

Similarly to the first embodiment, since it is possible to adjust the rotational position of the first cam 11, it is also possible to adjust the rotational position when holding the second member 2.

In the second embodiment, since the third cam 13 of the first embodiment is not provided, there is no function to hold the second member 2 in the closed position and the open position. However, since it is possible to adjust the rotational position when holding the second member 2, this rotational position can be adjusted at the closed position or the open position.

It should be noted that the present invention is not limited to the above-described embodiments, and can be modified to other embodiments within the scope of the gist of the present invention.

For example, although the first member of the hinge is attached to the main body, and the second member of the hinge is attached to the door in the above embodiments, the first member of the hinge can be integrated with the main body, and the second member of the hinge can be also integrated with the door.

In the first embodiment, when the second member is held in the closed position and the open position, the hinge is configured to hold the second member. The hinge is however configured to hold the second member when the second member is in one of the closed position or the open position.

The present specification is based on patent application No. JP 2017-225562 filed on Nov. 24, 2017. The contents of this application are incorporated herein in its entirety.

DESCRIPTION OF REFERENCES

1 . . . First member
2 . . . Second member
6 . . . Shaft body
11 . . . First cam
12 . . . Second cam
13 . . . Third cam
14 . . . Spring (biasing means)

What is claimed is:

1. A hinge, comprising:

a first member having an attaching portion and two cylindrical body portions, each cylindrical body portion having coaxial holes and a cam portion, the cylindrical body portions are spaced apart;

a second member having a second attaching portion and one cylindrical body portion with a hole coaxial with the coaxial holes of the first member;

wherein the first and second members are rotatable relative to each other;

a first cam with first and second cam surfaces on opposite sides of the first cam, the first cam surface engaging the first cam portion of the first member;

second and third cams non-rotatably inserted into the cylindrical body portion of the second member, the second and third cams being biased apart by a spring, the second cam engaging the second cam surface of the first cam, and the third cam engaging the second cam portion of the first member; and a shaft body inserted through the cylindrical body portions, the three cams, and the spring, the shaft body having a chamfered section which non-rotationally connects to the first cam, and the shaft body having a head portion exposed from the first member;

wherein the first cam surface and the first cam portion of the first member engage such that the rotation of the shaft allows the first cam to rotate, and such that the rotation of the second member does not rotate the first cam.

2. The hinge as claimed in claim 1, wherein an angle $\theta 1$ formed by an inclined surface of the first cam surface of the first cam is smaller than an angle $\theta 2$ formed by an inclined surface of the second cam surface of the first cam.

3. The hinge as claimed in claim 1, wherein the head portion of the shaft body has a hole.

* * * * *